US007175567B2

(12) United States Patent
Barbafieri et al.

(10) Patent No.: US 7,175,567 B2
(45) Date of Patent: Feb. 13, 2007

(54) GYMNASTICS SPRINGBOARD WITH ADJUSTABLE ELASTICITY DESIGNED FOR TRAINING AND COMPETITION

(75) Inventors: Gérard Barbafieri, Marseilles (FR); Henri Miceli, Marseilles (FR)

(73) Assignee: Gymnova SA, Marseilles (FR)

( * ) Notice: Subject to any disclaimer, the term of this patent is extended or adjusted under 35 U.S.C. 154(b) by 594 days.

(21) Appl. No.: 10/442,269

(22) Filed: May 21, 2003

(65) Prior Publication Data

US 2004/0235620 A1 Nov. 25, 2004

(51) Int. Cl.
*A63B 5/11* (2006.01)
*A63B 26/00* (2006.01)

(52) U.S. Cl. ..... 482/31; 482/30

(58) Field of Classification Search ..... 482/30–32, 482/51–53, 122, 128, 79–80, 140
See application file for complete search history.

(56) References Cited

U.S. PATENT DOCUMENTS

| | | | | |
|---|---|---|---|---|
| 1,210,920 | A * | 1/1917 | Fletcher | 482/31 |
| 2,996,295 | A * | 8/1961 | Smith | 267/178 |
| 3,497,217 | A * | 2/1970 | Feather | 482/10 |
| 3,968,964 | A * | 7/1976 | Grosser et al. | 482/31 |
| 4,460,170 | A | 7/1984 | Lundberg et al. | |
| 5,062,629 | A * | 11/1991 | Vaughan | 482/51 |
| 5,209,709 | A * | 5/1993 | Eyman, Jr. | 482/30 |
| 5,256,118 | A * | 10/1993 | Chen | 482/53 |
| 5,352,173 | A * | 10/1994 | McLaughlin | 482/123 |
| 5,370,591 | A * | 12/1994 | Jewell et al. | 482/30 |
| 5,509,871 | A * | 4/1996 | Giovanni | 482/51 |
| 6,705,975 | B2 * | 3/2004 | Kuo | 482/79 |
| 6,716,144 | B1 * | 4/2004 | Shifferaw | 482/140 |

FOREIGN PATENT DOCUMENTS

| | | | |
|---|---|---|---|
| DE | 3508931 | A1 * | 7/1986 |
| DE | 3602784 | A1 * | 3/1987 |
| GB | 2243304 | A * | 10/1991 |

* cited by examiner

*Primary Examiner*—Jerome Donnelly
*Assistant Examiner*—Fenn C. Mathew
(74) *Attorney, Agent, or Firm*—Oliff & Berridge, PLC

(57) ABSTRACT

A gymnastics springboard with adjustable elasticity comprising a top board coated with a coating subdivided into two distinct zones enabling the impact zone to be demarcated visually, which presents a homogeneous and flexible structure with a hardness able to be adjusted by means of:

a curved intermediate plate articulated on the frame at its bottom end by a hinge and bearing by rolling means at its top end under the middle of the impact zone of the board, an adjustable support bar cooperating with the curved intermediate plate between two longitudinal positions by maneuvering actuating member, said bar being guided by rails in the hole of the frame, and a system for quick addition or removal of springs positioned underneath the frame by a combined compression and rotation movement through the oblong holes.

19 Claims, 1 Drawing Sheet

GYMNASTICS SPRINGBOARD WITH ADJUSTABLE ELASTICITY DESIGNED FOR TRAINING AND COMPETITION

BACKGROUND OF THE INVENTION

Springboards for performing gymnastics are designed to improve gymnasts' performances in the execution of acrobatic figures or in vaulting over apparatus, in particular the vaulting horse or more recently the vaulting table.

These springboards have dimensions determined by the International Gymnastics Federation, which are currently 1200×600 mm with a height of 220 mm with an identical elasticity regardless of the gymnasts' weight which can vary from 30 kg to 80 kg.

STATE OF THE ART

Springboards with adjustable elasticity do exist, but the adjustment operations remain complicated, in particular if they require damping springs to be removed or added. Defects may occur that are liable to weaken the impact zones with risks of the board breaking, and to adversely affect the homogeneity of elasticity of the springboard. Furthermore, the effective impact zone is not always visually indicated on the top board of the springboard.

The document FR 9,102,434 describes a gymnastics springboard having a superficial coating which gives a material indication of the impact zone. This springboard is not designed for competition, as it does not have the required dimensions, and the elasticity of the impact zone is not homogeneous.

OBJECT OF THE INVENTION

The object of the invention is to overcome the shortcomings, and consists in achieving a gymnastics springboard for training and competition having a homogeneous impact zone and an elasticity that is able to be easily adjusted.

The springboard according to the invention comprises for this purpose a top board covered with a coating subdivided into two distinct zones enabling the impact zone to be defined visually, which presents a homogeneous and flexible structure with a hardness able to be adjusted by means of:

- a curved intermediate plate articulated on the frame at its bottom end by a hinge and bearing by rolling means at its top end under the middle of the impact zone of the board, the frame being wider than the curved intermediate plate,
- an adjustable support bar cooperating with the curved intermediate plate between two longitudinal positions by maneuvering an actuating member, said bar being guided by rails in the hole of the frame,
- and a system for quick addition or removal of springs positioned underneath the frame by a combined compression and rotation movement through the oblong holes.

DESCRIPTION OF A PREFERRED EMBODIMENT

FIG. 1 shows a perspective view of the springboard according to the invention. It comprises a top board (1) covered with a flexible coating equipped with visual locating means, a frame (2) formed by a base plate wherein a hole (3) is drilled, and a curved intermediate plate (5).

The upwardly curved plate (5) is equipped with hinges (6) at one of the ends thereof, with an adjustable support bar (7), and with roller means (8) at the opposite end bearing on the bottom face of the plate (1). An adjustment system (9) enables the elasticity to be adjusted and a securing strap (10) is arranged between the top plate (1) and the frame (2). Non-slip pads (not shown) are provided under the frame (2).

FIG. 2 is a top view of the springboard and represents the two distinct zones of the board (1) comprising a first zone A shown in dark color, constituting the inactive part of the springboard, and the second zone B constituting the more effective and homogeneous part of the springboard.

FIG. 3 shows the springboard seen from the side. The support bar (7) of the curved plate (5) is movable between the point C, which will make the springboard flexible, and the point D, which will make the springboard harder. The broken lines of the plate (1) represent the springboard under maximum load.

FIG. 4 shows a top view of the springboard after the board (1) and the curved intermediate plate (5) have been removed. The sliding system of the support bar (7) can be seen, as can a pair of guides (11 and 11') preventing any jamming effect when a quick adjustment lever (12) of the support bar (7) is actuated.

The adjustment lever (12) is fixed to the point (13) on the frame (2) and is articulated on the point (14). This lever is telescopic so as not to be salient from the springboard after adjustment has been made. A series of holes (15) and notches (16) are arranged in the frame (2) to allow the removable springs (4) to be positioned quickly.

The effective impact zone of the springboard can be easily located visually by the gymnast, is of adjustable hardness, and presents a homogeneous structure for all adjustments without weakening the springboard.

Figure 2:
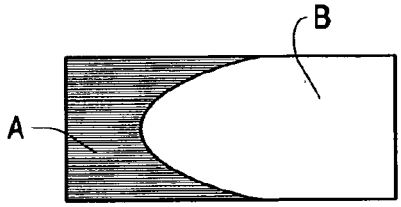

The non-slip coating which covers the board (1) of the springboard presents two different colors: one color defining the ineffective part A of the springboard (FIG. 2), and another color to attract the eye to the effective and homogeneous zone of the springboard (part B of FIG. 2).

The curved plate (5) is a flexible plate with spring effect presenting a rigid, resistant structure that is greatly deformable when a force is applied thereto. It is made of a resin-based composite material strengthened with fibers, notably glass fibers, carbon fibers or any other resistant flexible material.

Figure 3:
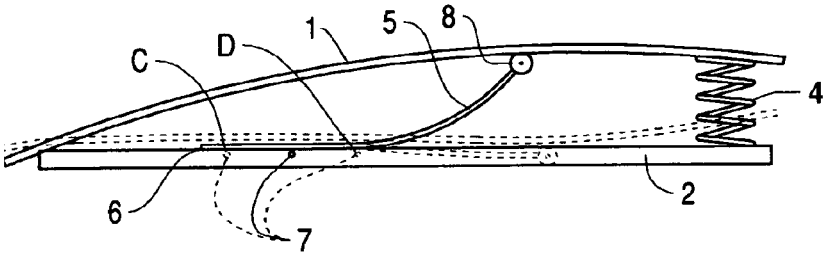
Figure 5:
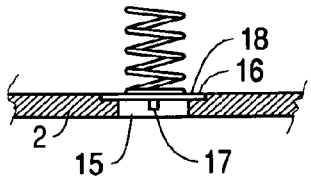
FIG. 5 shows, in cross-section, positioning of a removable spring (4) on the frame (2).

The rolling means (8) at the end of the curved intermediate plate (5) are arranged under the middle of the impact zone of the springboard, and serve the purpose of limiting the wear and friction and of not impeding the descent of the board (1) when the gymnast performs his jump. The total distance of movement of the rolling means (8) under the board (1) is about 30 mm between a no-load position and a maximum load position (the impact of the gymnast's jump) of about 2500 kg (see in broken line in FIG. 3). The small distance of movement prevents the homogeneity of the impact zone from being adversely affected. The hinge (6) gives the degrees of freedom of the curved intermediate plate (5) so as to make full use of the flexibility thereof.

Figure 4:
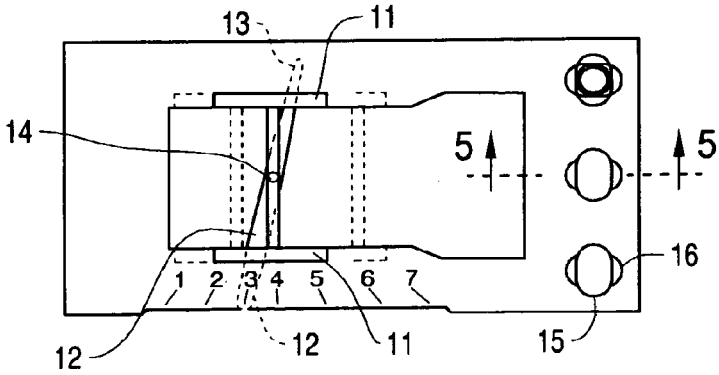
Figure 6:
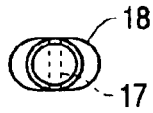
FIG. 6 represents a top view of FIG. 5, with the removable spring (4) bearing on the plate (18).

The adjustable support bar (7) of the intermediate plate (5) is formed by a round metal tube which is guided by means of rails (11 and 11'—FIG. 4) in the hole (3) of the frame (2). This movement from the point C to the point D (FIG. 3) either slackens or stiffens the end of the intermediate plate (5) located in the zone of impact of the springboard near the rollers (8).

Figure 1:
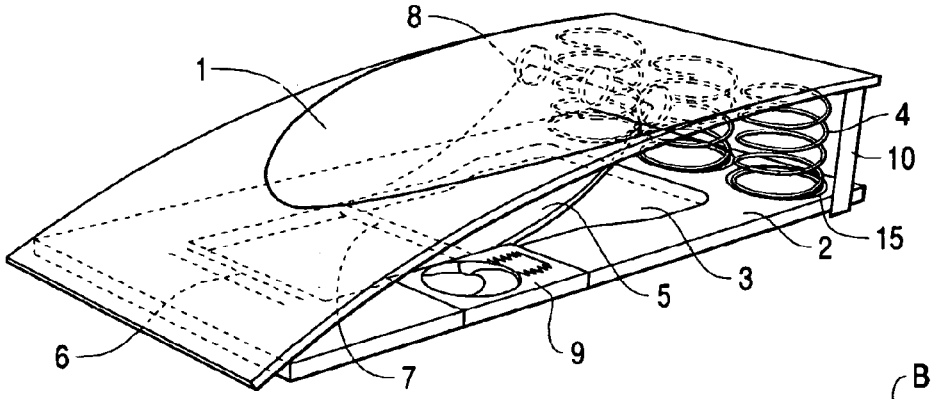

Movement of the support bar (7) is made possible by a rack (9—FIG. 1) or by a telescopic lever (12—FIG. 4), or any other system such as a pedal enabling quick adjustment to be made.

The hole (3) of the frame (2) serves the purpose of guiding the support bar (7), but also of housing the curved plate (5) completely when a violent impact (broken line in FIG. 3) takes place. The amplitude of depression of the board (1) is thereby increased thus enhancing the efficiency of the springboard.

The interchangeable spring system (4) enables springs to be removed or added, or the hardness or type of springs to be changed with great ease. The frame (2) can comprise a multitude of holes of oblong shape in order to adjust the number and location of the necessary springs (4) to suit the gymnast's weight.

To add a spring (4), the latter merely has to be inserted in an oblong hole on the frame (2), and then be compressed slightly against the board (1) and turned a quarter of a turn with the fixing toggle (17) to lock the plate (18) in the notches (16). The holes (15) and notches (16) can have different shapes (triangular, rectangular, or any other shape other than circular).

The combination of the two assemblies formed by the adjustable curved plate (5) and the interchangeable springs (4) enables a springboard to be provided which can be adapted very quickly and very easily to suit gymnasts of different weights (from 30 to 80 kg).

The invention claimed is:

1. A gymnastics springboard with adjustable elasticity, comprising a top board including an impact zone and presenting a homogeneous and flexible structure with a hardness able to be adjusted by:

a curved intermediate flexible plate articulated on a frame at one end by a hinge and bearing by a roller at a second end of the frame under a middle portion of the impact zone of the top board, the frame being wider than the curved intermediate flexible plate, an adjustable support bar located under the curved intermediate flexible plate, the adjustable support bar being guided between two longitudinal positions by rails in a hole of the frame, an actuating member for moving the adjustable support bar between the two longitudinal positions to adjust elasticity of the curved intermediate flexible plate, and means for enabling quick addition or removal of springs located between the top board and the frame.

2. The gymnastics springboard according to claim 1, wherein the top board is covered with a coating subdivided into two distinct zones, one of the zones being the impact zone.

3. The gymnastics springboard according to claim 2, wherein the impact zone and the other distinct zone present contrasted colors.

4. The gymnastics springboard according to claim 2, wherein the impact zone is defined visually.

5. The gymnastics springboard according to claim 1, wherein the curved intermediate flexible plate is made of a resin-based composite material strengthened with fibers.

6. The gymnastics springboard according to claim 5, wherein the fibers comprise glass fibers or carbon fibers.

7. The gymnastics springboard according to claim 1, wherein the means for enabling addition or removal of springs comprise non-circular holes of the frame, each sized to allow a spring mounted on a non-circular base to pass through when the base is in a first orientation relative to the non-circular hole, and shaped to not allow the non-circular base to pass through when the non-circular base is in a second orientation relative to the non-circular hole.

8. The gymnastics springboard according to claim 7, further comprising notches in the frame, the notches accommodating the non-circular bases.

9. The gymnastics springboard according to claim 1, wherein the actuating member comprises a rack with an adjustment wheel enabling adjustment to be performed quickly.

10. The gymnastics springboard according to claim 1, wherein the actuating member comprises an adjustment lever.

11. The gymnastics springboard according to claim 1, wherein the springs are positioned between the top board and the frame by a combined compression and rotation movement through oblong holes.

12. A gymnastics springboard with adjustable elasticity, comprising a top board including an impact zone and presenting a homogeneous and flexible structure with a hardness able to be adjusted by:

a curved intermediate flexible plate articulated on a frame at one end by a hinge and bearing by a roller at a second end of the frame under a middle portion of the impact zone of the top board, the frame being wider than the curved intermediate flexible plate, an adjustable support bar located under the curved intermediate flexible plate, the adjustable support bar being guided between two longitudinal positions by rails in a hole of the frame, an actuating member for moving the adjustable support bar between the two longitudinal positions to adjust elasticity of the curved intermediate plate, and notches in the frames, the notches accommodating bases of springs located between the top board and the frame.

13. The gymnastics springboard according to claim 12, wherein the top board is covered with a coating subdivided into two distinct zones, one of the zones being the impact zone.

14. The gymnastics springboard according to claim 13, wherein the impact zone is defined visually.

15. The gymnastics springboard according to claim 14, wherein the impact zone and the other distinct zone present contrasted colors.

16. The gymnastics springboard according to claim 12, wherein the curved intermediate flexible plate is made of a resin-based composite material strengthened with fibers.

17. The gymnastics springboard according to claim 16, wherein the fibers comprise glass fibers or carbon fibers.

18. The gymnastics springboard according to claim 12, wherein the actuating member comprises a rack with an adjustment wheel enabling adjustment to be performed quickly.

19. The gymnastics springboard according to claim 12, wherein the actuating member comprises an adjustment lever.

* * * * *